US009273555B2

(12) United States Patent
Garner et al.

(10) Patent No.: US 9,273,555 B2
(45) Date of Patent: Mar. 1, 2016

(54) POSITIVE DISPLACEMENT PUMP WITH IMPROVED SEALING ARRANGEMENT AND RELATED METHOD OF MAKING

(75) Inventors: Bob Garner, Sturtevant, WI (US); James G. Rankel, Wauwatosa, WI (US)

(73) Assignee: Ampco Pumps Company, Glendale, WI (US)

( * ) Notice: Subject to any disclaimer, the term of this patent is extended or adjusted under 35 U.S.C. 154(b) by 602 days.

(21) Appl. No.: 13/601,078

(22) Filed: Aug. 31, 2012

(65) Prior Publication Data

US 2014/0065002 A1 Mar. 6, 2014

(51) Int. Cl.

| | |
|---|---|
| ***F01C 19/00*** | (2006.01) |
| ***F04C 2/12*** | (2006.01) |
| ***F04C 15/00*** | (2006.01) |

(52) U.S. Cl.

CPC ..... *F01C 19/005* (2013.01); *F04C 2/123* (2013.01); *F04C 15/0038* (2013.01); *F04C 15/0076* (2013.01); *F04C 2230/60* (2013.01); *F04C 2240/51* (2013.01); *Y10T 29/49238* (2015.01)

(58) Field of Classification Search

CPC ..... F01C 19/005; F04C 15/0038; F04C 15/0076; F04C 2230/60; F04C 2240/51; F04C 2/123; Y10T 29/49238

USPC ..... 418/120, 132, 141, 206.1, 206.2, 206.6, 418/206.7, 206.8

See application file for complete search history.

(56) References Cited

U.S. PATENT DOCUMENTS

| | | | | |
|---|---|---|---|---|
| 6,328,547 | B1 * | 12/2001 | Morita | 418/206.1 |
| 7,905,717 | B2 | 3/2011 | Whittome et al. | |
| 8,007,264 | B2 | 8/2011 | Drew et al. | |
| 9,062,676 | B2 * | 6/2015 | Garner | |
| 2002/0159906 | A1 * | 10/2002 | Phallen et al. | 418/132 |
| 2007/0158151 | A1 * | 7/2007 | Deconti | 188/264 D |
| 2008/0069707 | A1 * | 3/2008 | Van Norman et al. | 417/410.1 |

OTHER PUBLICATIONS

IDEX Corporation—Viking Pump; Classic+ Industrial Lobe Pumps product description; Sep. 2007; 8 pages.

SPX Corporation—Waukesha Cherry-Burrell; Universal 2 Series product description; Nov. 2011; 12 pages.

JEC Pump website product description; http://www.jecpump.com/product/01_3view.html; printed Aug. 30, 2012; listed copyright date 2006; 2 pages.

JEC Pumps; Always a Step Ahead product brochure; obtained from http://www.prestigepumps.co.uk/data/downloads/JEC_2010_GENERAL.pdf; PDF creation date 2010, per document properties; 12 pages.

(Continued)

*Primary Examiner* — Jorge Pereiro
*Assistant Examiner* — Paul Thiede
(74) *Attorney, Agent, or Firm* — Quarles & Brady LLP

(57) ABSTRACT

A rotary positive displacement pump has a front-loading seal arrangement to better accommodate servicing and cleaning of the pump body. The pump includes a sliding seal subassembly disposed in a volume between a central portion of a rotor that is received on a shaft of a gear case and the hub of the pump body. A related method of modifying a rotary positive displacement pump enables a conventional pump with a rear-side seal arrangement to be transformed into a pump having a front-loading seal arrangement. In addition to the reduction of a dead zone in which turbulent flow does not occur by inclusion of the sliding seal subassembly, other modifications to the pump body improve the ability of the pump to be cleaned in place.

23 Claims, 8 Drawing Sheets

(56) References Cited

OTHER PUBLICATIONS

Alfa Laval; SX Rotary lobe pump description; http://www.alfalaval.com/solution-finder/products/sx-rotary-lobe-pump/pages/howitworks.aspx; dated printed: Aug. 30, 2012; 1 pages.

Alfa Laval; Positive Displacement Pumps—Pure and Simple; product brochure; copyright 2001; 8 pages.

Tri-Clover; TCIP Pump Service & Installation Manual; obtained from http://www.flowtrend.com/manuals/Alfa%20Laval%20-%20Tri%20Clover%20Service%20Manuals/Positive%20Displacement%20Pumps/TCIP%20Series.pdf; PDF modification date 2004, per document properties; 52 pages.

ZM Technologies; Zero Maintenance Pumps, The Standard ZW U1 Pump & The Evolution Pump brochure; obtained at Nov. 2011 trade show; 2 pages.

* cited by examiner

POSITIVE DISPLACEMENT PUMP WITH IMPROVED SEALING ARRANGEMENT AND RELATED METHOD OF MAKING

CROSS-REFERENCE TO RELATED APPLICATIONS

Not applicable.

BACKGROUND

This disclosure relates to positive displacement pumps. In particular, this disclosure relates to improvements for rotary positive displacement pumps such as circumferential piston pumps, for food processing or industrial applications.

Pumps, such as rotary positive displacement pumps, can be used to transport fluids through a system. In a rotary positive displacement pump, two or more counter-rotating lobes are disposed in a cavity typically defined by a pump body and an associated cover. This cavity has an inlet on one side of the rotary lobes through which the fluid material is initially received and an outlet on the other side of the rotary lobes through which the fluid material is forced out of the pump. A gear case, which typically supports the pump body, has shafts that attach to the rotors. When the gear case drives the rotation of these shafts, the attached rotors rotate, thereby causing the pumping action.

Although positive displacement pumps of the type described above have existed for some period of time, the continued maintenance and service of these pumps has presented unique challenges. Particularly as health and sanitation standards have become more stringent, maintaining the required levels of cleanliness has become an expensive endeavor, often requiring complex disassembly and reassembly of the pump.

With thousands of pumps of this kind in service throughout the world, there is a continued need for improvements.

SUMMARY OF THE INVENTION

An improved pump assembly as well as a method of modifying existing rotary positive displacement pumps for improved performance and serviceability is disclosed.

As will be described in further detail below, the industry-standard rotary positive displacement pump structure, such as the Ampco Pumps® ZP2 Series Positive Displacement Pumps, the Waukesha Cherry-Burrell® Universal II Series PD Pumps, or the Wright Flow Technologies® TRA20 Series Pumps, require that the entire pump body be detached from the gear case in order to service the seals that are disposed between the gear case and the pump body. For decades this has meant that, in order to service or clean portions of the pump, the pump would need to be subject to long periods of downtime in which the pump body would need to be removed from the gear case in order to access the seals.

Additionally, the industry-standard rotary positive displacement pumps have "dead zones" in which the fluid being transported may collect and stagnate. Attempting a clean-in-place (CIP) process to clean a pump with such dead zones was problematic because even when a cleaning fluid was introduced, the fluid might not reach and clean these dead zones at all or would only do so if cleaning was performed for a long duration of time.

The improved pump that is now disclosed provides a front-loading seal construction and eliminates "dead zones" within the pump cavity. Notably, while newly-built rotary positive displacement pumps can be constructed to have these advantages, it is also possible to modify or re-build existing industry-standard rotary positive displacement pumps to include these advantages. This means that thousands of pumps which are currently in service do not need to be replaced, but merely rebuilt, in order to achieve many of the benefits of the new structure.

According to one aspect of the invention, a rotary positive displacement pump is disclosed for pumping a fluid. The rotary positive displacement pump includes a gear case supporting a pump body having a cover attached to the pump body. A cavity is defined between the pump body and the cover that has an inlet and an outlet. Inside the cavity of the pump body, the pump body has a pair of hubs that extend into the cavity. Each of the pair of hubs has an axially-extending opening through each one of which a corresponding one of a pair of shafts from the gear case is received. Inside the axially-extending opening of the hub, each of the pair of shafts have a central portion of a rotor received on the shaft. Each rotor has wings attached to the respective central portion of the rotor in which the wings are disposed radially outward of the hub when the central portion of the rotor is attached to the shaft. The rotors are rotatable in opposite directions to pump a fluid through the pump body from the inlet through the cavity to the outlet. A sliding seal subassembly is disposed in a volume between the central portion of each of the rotors and the corresponding hub in the pump body.

According to another aspect of the invention, a method of modifying a rotary positive displacement pump of the type described above is disclosed. The method includes removing a volume of material from each of the hubs on a radially inward facing surface of the axially-extending openings of the hubs to enlarge at least a portion of the axially-extending openings and assembling sliding seal subassemblies between the central portion of the rotors and the hubs of the pump body.

Additionally, other modifications to the pump body and rotor are disclosed that improve the ability of the pump to be cleaned in place. This might be achieved by structurally altering the pump body and/or rotor to reduce number of areas that are not subject to turbulent flow and by removing material from the lateral walls of the pump body to provide for free drainage in the area between the rotors and the cover without sacrificing pump efficiency.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENT

Figure 1:
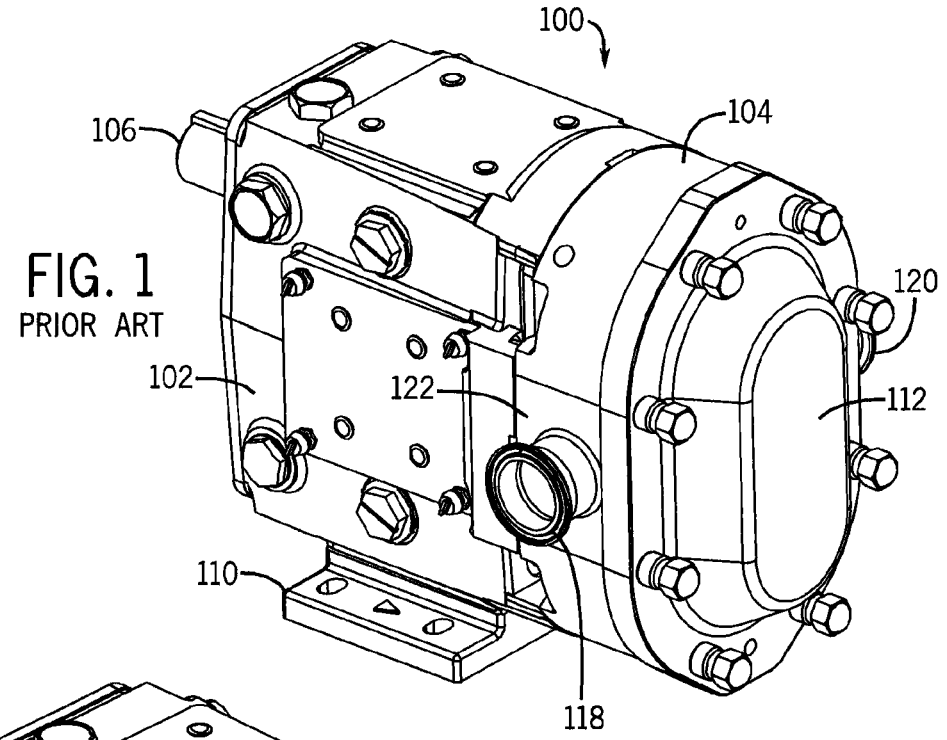
FIG. 1 PRIOR ART
FIG. 1 is a perspective view of a prior art universal pump.

The various parts of a prior art pump 100 in FIGS. 1-3 will now be described in greater detail before proceeding on to a further detailed description of the new pump 200 in FIGS. 4-8. The new pump 200 is a modified and improved version of the prior art pump 100. It will be appreciated that a number of components or parts of the prior art pump 100 of FIGS. 1-3 and the new pump 200 of FIGS. 4-8 are similar; however, there are also differences between the prior art pump 100 and the new pump 200. Accordingly, the following detailed description is to be read with reference to the figures, in which like elements in different figures have like reference numerals. In the instances where differences exist between the prior art pump 100 and the new pump 200, those differences will be described in the text of this specification and/or illustrated in the figures.

Figure 2:
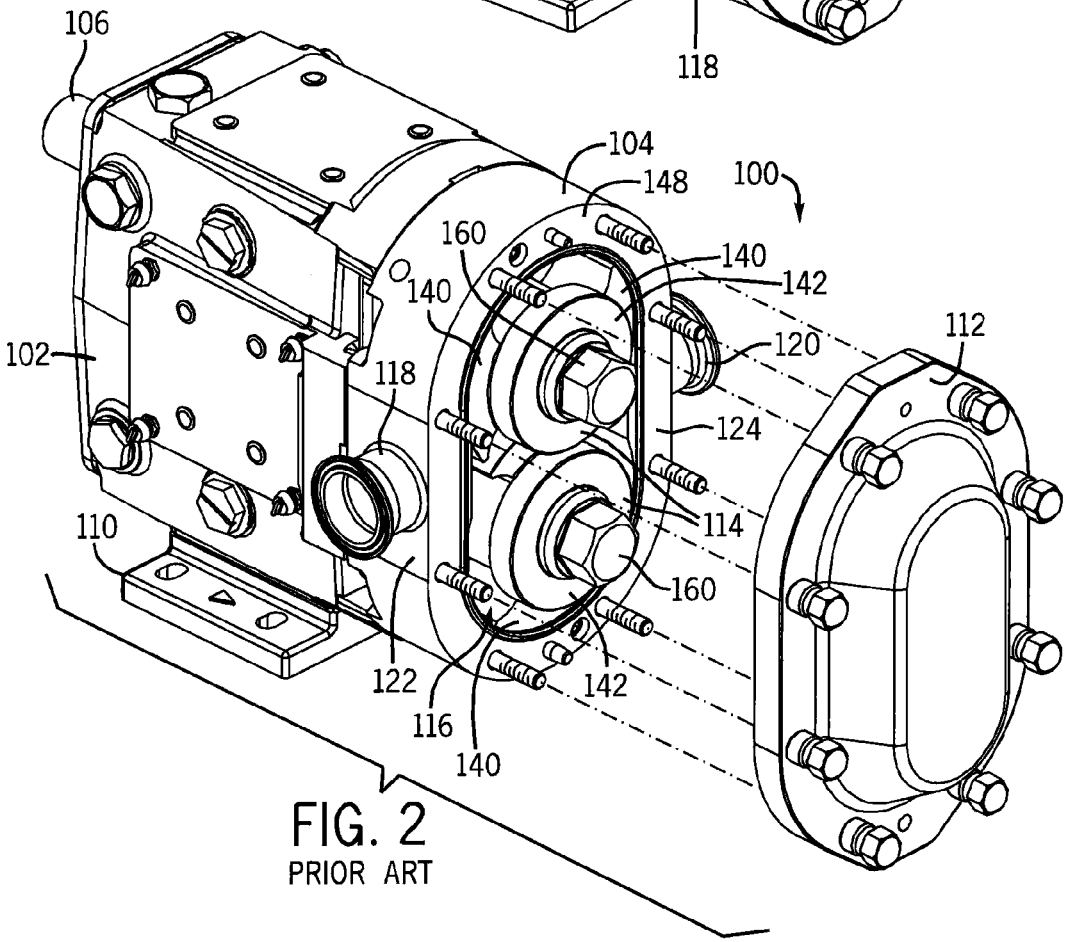
FIG. 2 PRIOR ART
FIG. 2 is a perspective view of the prior art pump of FIG. 1 in which the cover has been removed to illustrate the arrangement of the rotors in the pump body.
Figure 3:
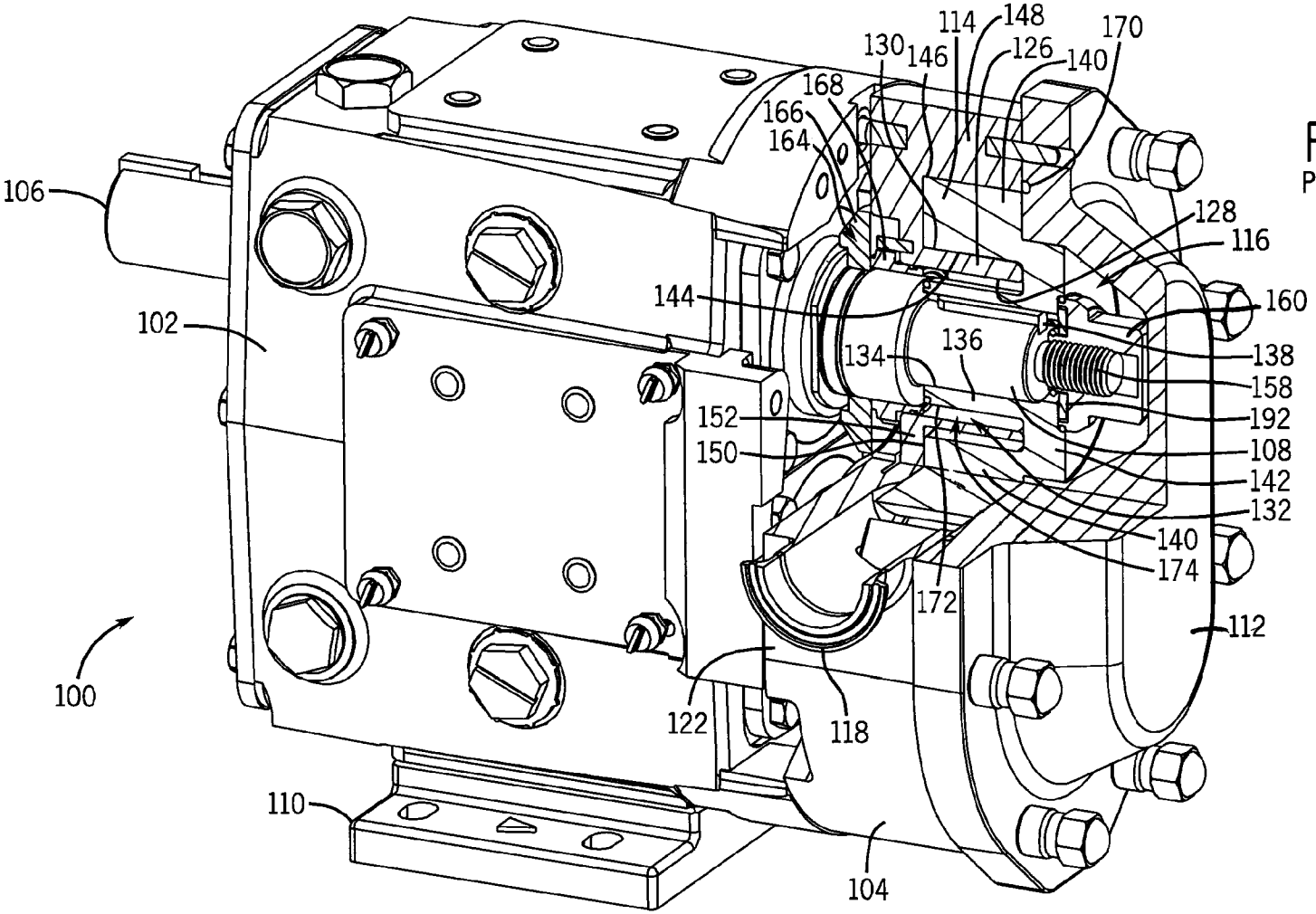
FIG. 3 PRIOR ART
FIG. 3 is a partial cross-sectional view taken through the pump body showing the volume of the pump body in which one of the rotors is received on a shaft and the related sealing and connection.
Figure 4A:
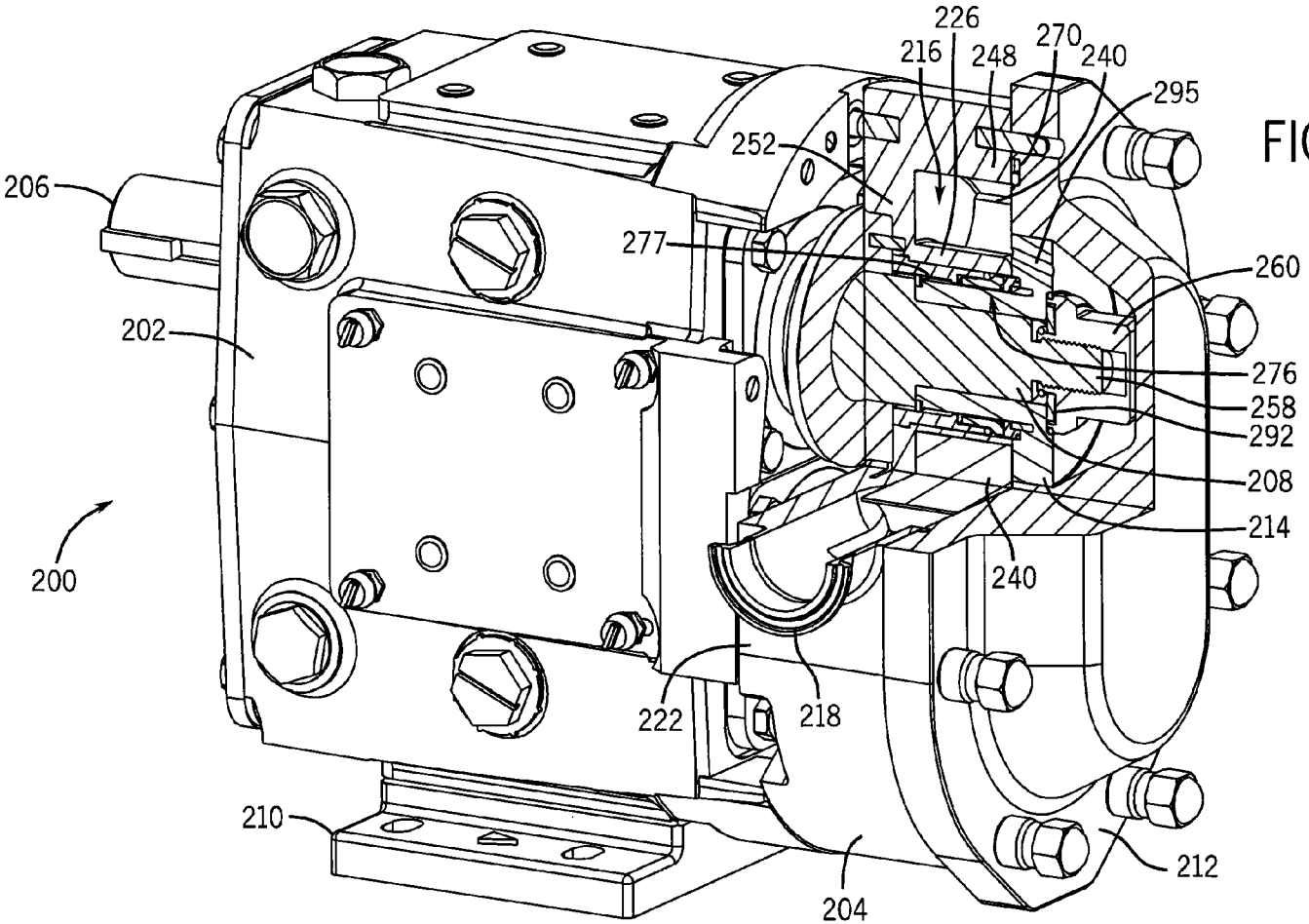
FIG. 4A is a partial cross-sectional view similar to that in FIG. 3, but that is taken through the new pump according to this disclosure.
Figure 4B:
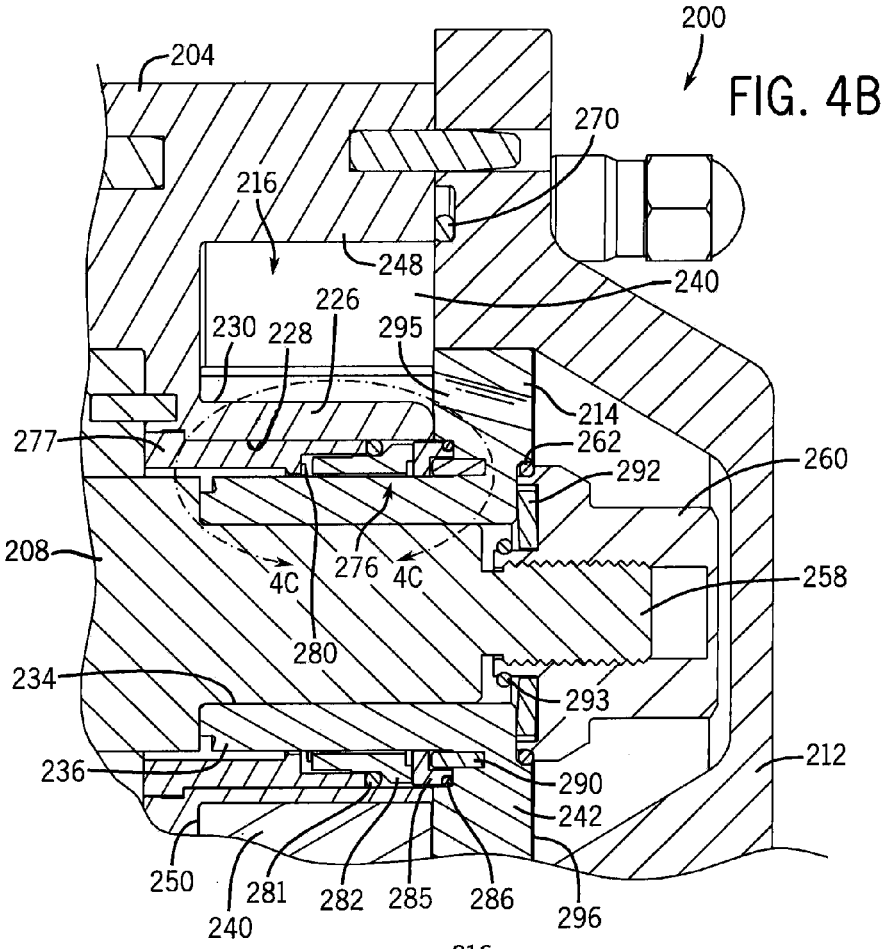
FIG. 4B is a detailed cross-sectional side plan view of the new pump illustrating the new sliding seal subassembly between the pump body and the rotor.
Figure 4C:
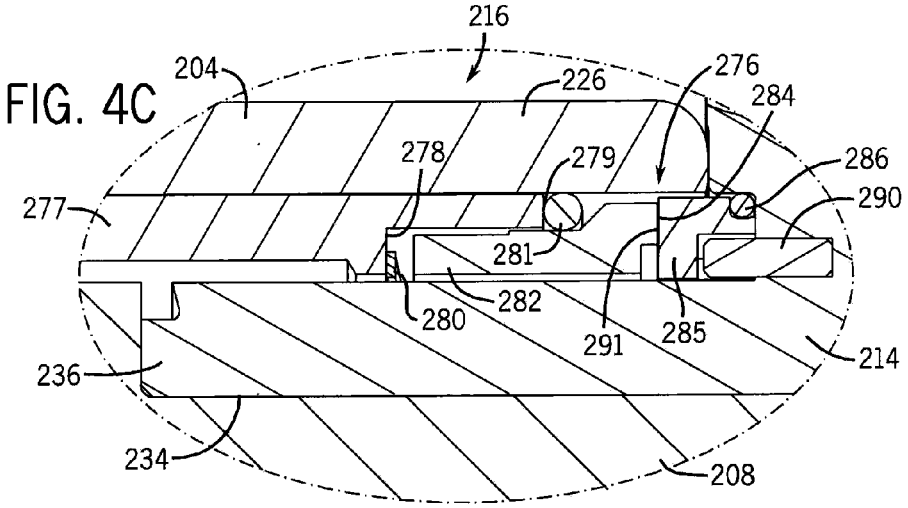
FIG. 4C is a detailed cross-sectional side plan view of the sliding seal subassembly taken in area 4C-4C of FIG. 4B.
Figure 5:
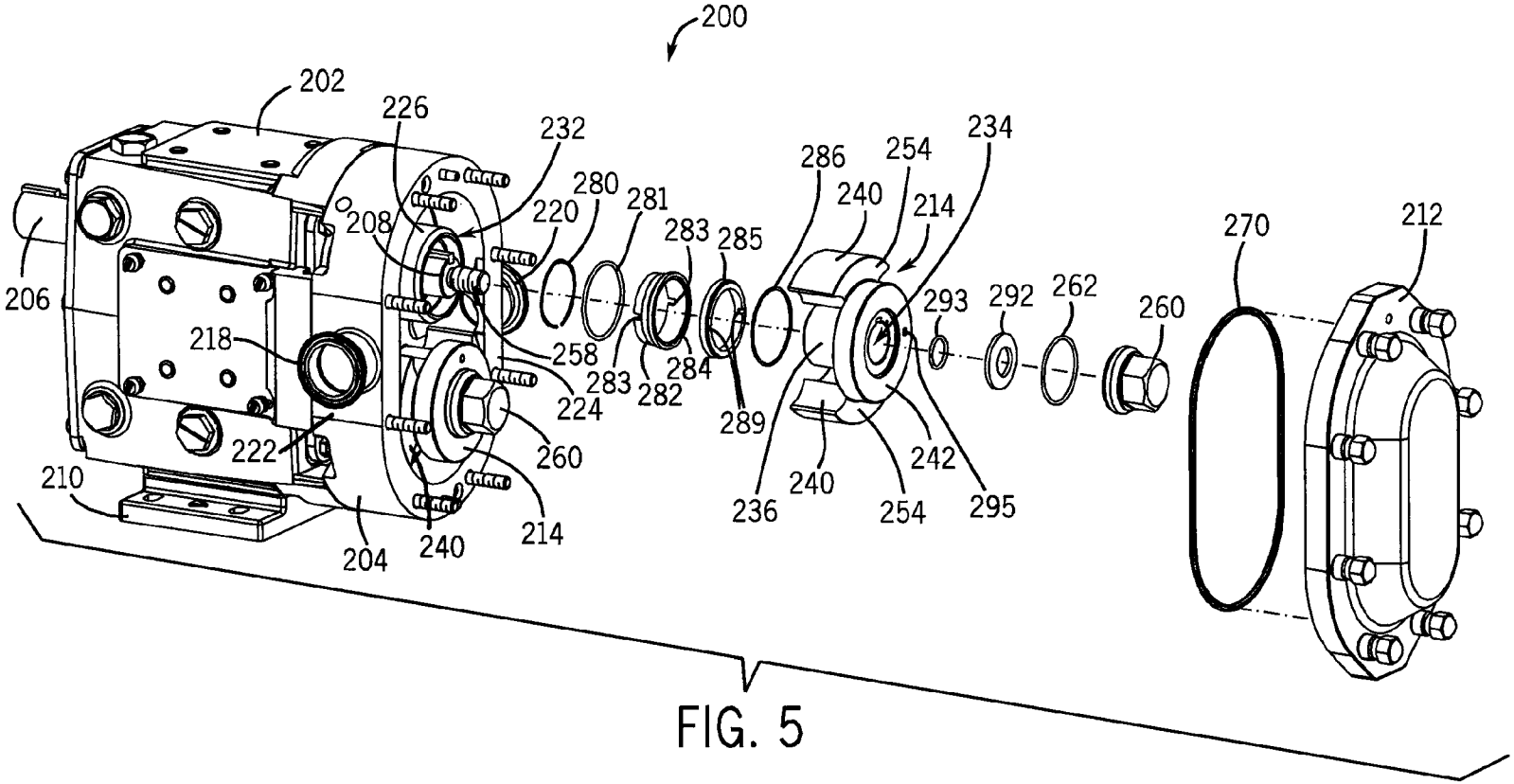
FIG. 5 is an exploded perspective view of the new pump in which the various items of the seal structure and the rotor are shown.
Figure 6:
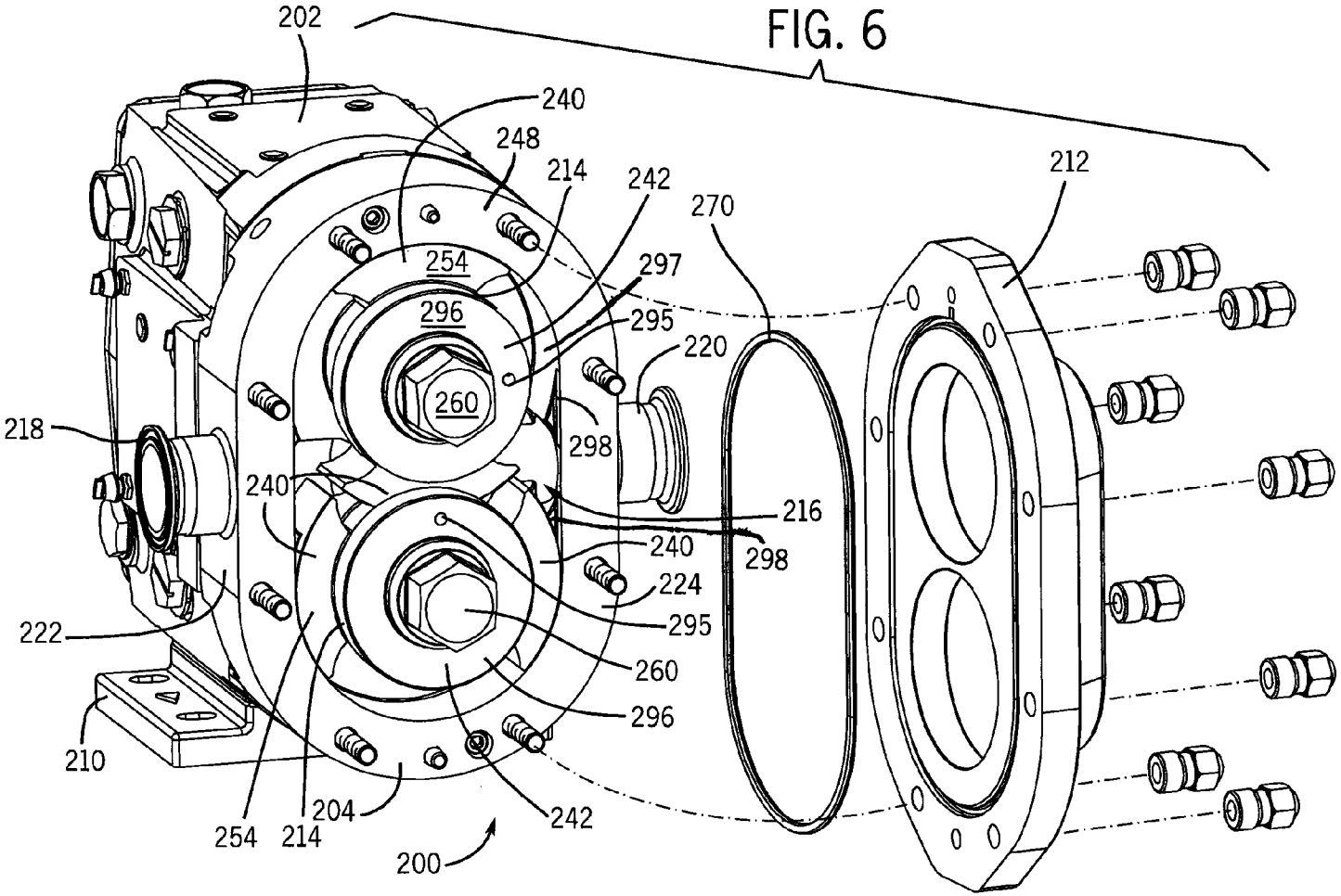
FIG. 6 is a view of the new pump with the cover removed from the pump body so as to show the rear side of the cover.

Referring first to FIGS. 1-3, a prior art rotary positive displacement pump 100 is illustrated. The pump 100 illustrated in FIGS. 1-3 is an Ampco Pumps® ZP2 Series circumferential piston pump, which is a kind of positive displacement pump. This particular style of pump is typically utilized in sanitary applications, such as dairy and food processing, to transport fluid from an inlet line connected through the pump 100 to an outlet line.

In general construction, the pump 100 includes a gear case 102 with a front end that supports a pump body 104 on a rear side of the pump body 104. The gear case 102 and the pump body 104 may be connected to one another in a number of ways including using bolts or other fasteners. As will be described in greater detail below, portions of the gear case 102, such as output shafts, can extend into the pump body 104. In order to prevent leakage in this area of insertion in the prior art pump 100, there will be a sealing arrangement disposed between portions of the gear case 102 and the pump body 104.

Looking more closely at the gear case 102, the gear case 102 is adapted to translate a single input rotary torque into a pair of counter-rotational output rotary torques. In the particular form illustrated, the gear case 102 is configured or adapted to receive an input rotary torque at a keyed input shaft 106 at the rear end of the gear case 102. This keyed input shaft 106 may be coupled to a motor (not shown) using a coupling (not shown) such that the input shaft 106 receives the input torque. This input torque is then translated and divided within the gear case 102 into a pair of counter-rotational torques that are provided to a pair of output shafts 108 on the front end of the gear case 102. In the form illustrated, the pair of output shafts 108 of the gear case 102 are parallel with one another and also with the input shaft 106. Because the translation and division of such torques and rotary motion is known within the gear case art, a greater description of the interior of the gear case 102 is unnecessary. Moreover, it will be appreciated that other styles of gear cases might be used with the improvements described herein.

As illustrated, a mounting base 110 is also attached to the gear case 102 for attaching the pump 100 to a mounting surface. Although an upright orientation of gear case 102 and pump 100 is shown in the figures, it will be appreciated that the gear case 102 is adapted for connection to a variety of mounting arrangements including bottom, top, and side mounting arrangements.

Now returning to the pump body 104 and with specific reference to FIG. 2 in which a cover 112 has been removed from a front side of the pump body 104, the pump body 104 houses a pair of intermeshed rotors 114 that are received in an internal cavity 116 of the pump body 104. The internal cavity 116 is defined by the walls of the pump body 104 and the cover 112, when the cover 112 is attached to the pump body 104. A fluid inlet 118 and a fluid outlet 120 are disposed on respective opposing lateral sidewalls 122 and 124 of the pump body 104 and the inlet 118 and the outlet 120 are in fluid communication with the internal cavity 116 of the pump body 104. If one were to draw a line between the inlet 118 and the outlet 120, this line would extend through the area in which the rotors 114 intermesh.

Figure 7:
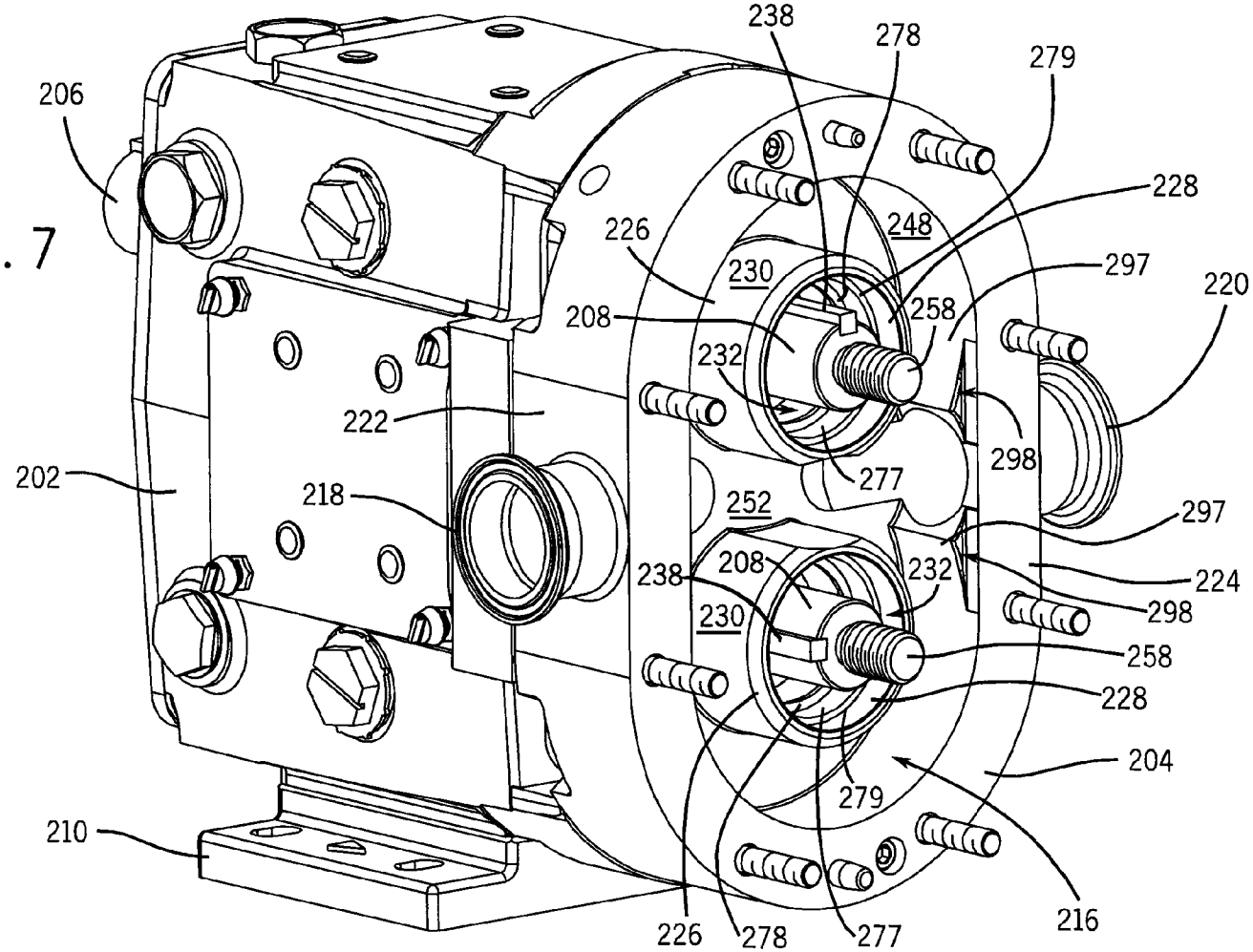
FIG. 7 is a perspective view of the new pump similar to FIG. 6, but in which the rotors and sliding seal subassemblies have been removed to better show the hubs and shafts.

As can be best seen in FIG. 3 and in FIG. 7 which illustrates the new pump 200, a pair of hubs 126, 226 protrude from the rear wall of the pump body 104, 204. Although only the top hub is illustrated in FIG. 3 due to the particular line through which the cross-section is taken, a bottom hub that is generally similar to the top hub can be found under the lower rotor. Because the cover 212, the rotors 214, and the sliding sealing subassembly has been removed in FIG. 7, FIG. 7 best illustrates the structure of the hubs 226 relative to the rest of the pump body 204. However, it should be appreciated that the hubs 226 of pump body 204 represent a modified version of the hubs 126 of the pump body 104. To best appreciate a difference between the hubs 126 and the hubs 226, the cross-sections of FIGS. 3 and 4B should be compared.

Each of the pair of hubs 126 are generally cylindrically tubular shaped protruding from a base wall of the pump body 104 and have a radially inward facing surface 128 and a radially outward facing surface 130 (the radially outward facing surface 130 extends around only a portion of the total circumference of the hub 126, as there is a cutout region for accommodating the passage of the wings of the adjacent rotor). As will be described in greater detail below, the radially inward facing surface 128 of the hubs 126 in the prior art pump 100 can be altered or modified to receive an inserted sleeve with axial faces for reception of sliding seal subassembly parts (or to be otherwise formed so as to include axial faces for this purpose).

The pair of hubs 126 each have an axially-extending opening 132 in which one of the pair of output shafts 108 of the gear case 102 is received. This is perhaps best illustrated in FIG. 7, in which the axially-extending openings 232 in hubs 226 are depicted with the pair of output shafts 208 co-axially extending there through.

The pair of output shafts 108 are keyed such that the rotor 114 received on the output shaft 108 can be rotationally driven by the rotation of the shafts 108. As best seen in FIG. 3, the rotor 114 is received onto the shaft 108 by telescopically inserting an opening 134 of a central portion 136 of the rotor 114 onto the shaft 108 such that the central portion 136 of the rotor 114 is disposed between the hub 126 and the shaft 108. The profile of the opening 134 on the rotor 114 and the profile of the shaft 108 with a key 138 already inserted therein can have a similar cross sectional profile so that the rotor 114 is driven by the rotation of the shaft 108 via the key 138 and keyways formed in the shaft 108 and the rotor 114.

Figure 8:
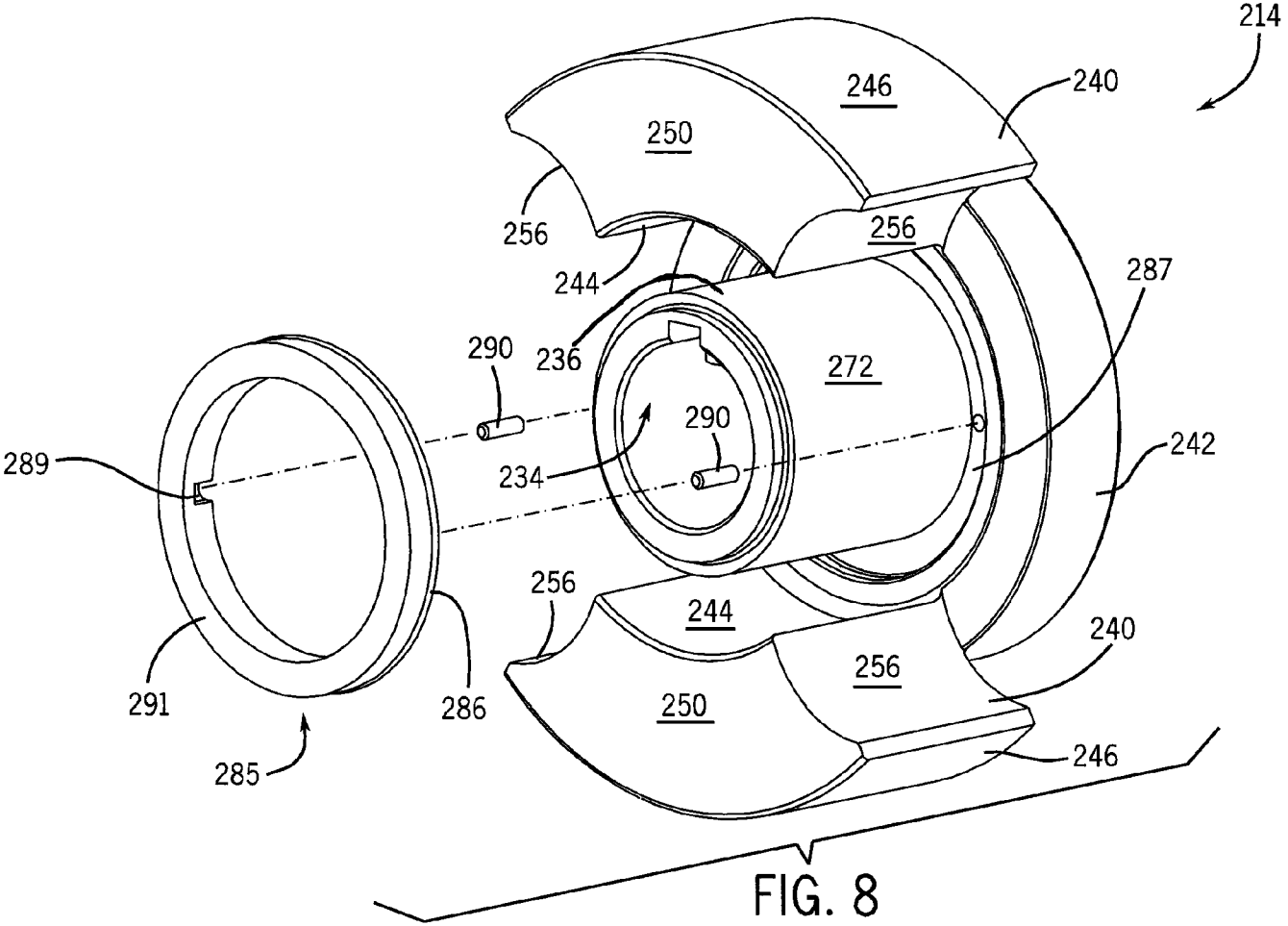
FIG. 8 is a rear perspective view of one of the rotors in which a portion of the seal structure is shown being attached.

As best seen in FIG. 8, which shows the rear side of one of the rotors 214 (which is otherwise similar to rotors 114, except in the ways described below), each rotor 114, 214 includes two wings 140, 240 that are disposed on the outside of the hub 126, 226 when the rotors 114, 214 are installed in the pump body 104, 204). That is to say, the wings 140, 240 are disposed radially outward of the radially outward facing surface 130, 230 of the hub 126, 226 when the pump 100, 200 is assembled. It will be appreciated that while two wings 140, 240 are illustrated on each rotor 114, 214, that variations on the type of rotor and the number of wings or lobes can be made. For example, in certain pumps, the wings may be replaced by lobes and/or there may be only a single wing, two wings, or more than two wings or lobes.

In order to link the central portion 136, 236 of the rotor 114, 214 (which is disposed in the axially-extending opening 132, 232 of the hub 126, 226) to the wings 140, 240 (which are disposed on the outside of the hub 126, 226), the rotor 114, 214 includes a disc-shaped portion 142, 242 on the forward axial end of the rotor 114, 214 that links the central portion 236 to the wings 140, 240. In the form shown, this disc-shaped portion 142, 242 is integrally formed with both the central portion 136, 236 and the wings 140, 240 of the rotor 114, 214. When assembled, the disc-shaped portion 142, 242 of the rotor 114, 214 is forward of the front axial end of the hub 126, 226.

By having portions of the various surfaces of the wings 140, 240 of the rotor 114, 214 closely match the surfaces that they pass during rotation within the pump body 104, 204, the rotors 114, 214 can efficiently turn their rotation into a pumping force on the fluid being transported. A radially inward facing surface 144, 244 of the wings 140, 240 are generally shaped so as to be closely positioned to the radially outward facing surface 130, 230 of the hub 126, 226 and a radially outward facing surface 146, 246 of the wings 140, 240 are generally shaped so as to be closely positioned to at least a portion of a side wall 148, 248 defining a portion of the internal cavity 116, 216 of the pump body 104, 204. Additionally, a rear axial surface 150, 250 of each of the wings 140, 240 is closely positioned to a rear wall 152, 252 of the internal cavity 116, 216 and the front axial surfaces 154, 254 of the wings 140, 240 and a radially outward facing wall 156, 256 of the disc-shaped portion 142, 242 all can be closely positioned to the back side wall of the cover 112.

When both rotors 114 are attached, because the rotors 114 each include two wings 140, the rotors 114 are 90 degrees out of phase with one another on the shafts 108, as best depicted in FIG. 2. This permits the intermeshing of the wings 140 of the rotors 114 when the rotors 114 are spun in opposite directions about their respective axes of rotation. Both the angular ends 156, 256 of the wings 140, 240 and a portion of the hubs 126, 226 (for example, see FIG. 7, indicating portions 258 of the hubs 226 which have a similar exterior profile as the hubs 126) can have concave arcuate sections so as to provide clearance as the rotors 114, 214 rotate within the internal cavity 116, 216 of the pump body 104, 204.

In order to axially secure the rotor 114, 214 on the shaft 108, 208, a fastening element engages both the rotor 114, 214 and the shaft 108, 208. In the particular form illustrated, on the end of the shaft 108, 208 furthest from the gear case 102, 202, the shaft 108, 208 has a threaded portion 158, 258 which extends out of the front side of the opening 134, 234 of the central portion 136, 236 of the rotor 114, 214. A nut 160, 260 can be fastened to the threaded portion 158, 258 on the end of the shaft 108, 208 so as to secure the rotor 114, 214 on the shaft 108, 208. In order to provide a seal between the nut 160, 260 and the front face of the rotor 114, 214 there may be an o-ring compressed there between (such as the o-ring 262 illustrated in FIG. 4B) and a Bellville washer 192, 292 or other intermediate element may be present between the nut and the front side of the rotor 114.

With the structure of the pump 100 having been described, the general operation of the pump 100 will now be explained. In general operation, the inlet 118 and the outlet 120 are connected to an inlet line that provides a fluid and an outlet line, respectively. With the inlet and outlet lines attached to the pump body 104, the rotors 114 are driven in opposing rotational direction (e.g., clockwise and counter-clockwise) by output shafts 108 of the gear case 102 in order to pump a fluid received at the inlet 118 through the internal cavity 116 of the pump body 104 and out the outlet 120. It will be appreciated that the inlet 118 and outlet 120 are relative terms, as the rotors 114 can be driven in the opposite direction to provide a pumping action in a reverse direction.

In order to prevent the fluid being pumped through the pump body 104 from leaking, a number of seals are provided. However, the sealing arrangement differs between the prior art pump 100 and the new pump 200.

Most notably, during assembly of the prior art pump 100, a sealing arrangement 164 is captured between the front side of the gear case 102 and a rear wall of the pump body 104. This sealing arrangement 164 might include a single mechanical seal or a double mechanical seal but, in either event, installation of the sealing arrangement 164 requires that a seal seat 166 and seal seat o-ring to be received on the base of the shaft 108. Then, a single or double mechanical seal to be inserted into the rear side of the pump body 104 including a stationary seal 168. Although great detail is not provided in FIG. 3, o-rings are at a minimum provided between the seal seat 166 and the shaft 108 and between the stationary seal 168 and the pump body 104 such that, when the stationary seal 168 is compressed against the seal seat 166 during attachment of the pump body 104 to the gear case 102, seals are formed that prevent the escape of the fluid being pumped back through this sealing arrangement 168.

It should be stressed that this sealing arrangement 168 between the pump body 104 and the gear case 102 requires the pump body 104 to be separated from the gear case 102 in order to service the sealing arrangement 168. Unfortunately, this can mean that when inlet and outlet lines are connected to the pump body 104, that these lines will typically need to be disconnected prior to removal of the pump body 104 which is both time-consuming and prone to the introduction of error. The re-assembly of the pump 100 and the reconnection of the inlet and outlet lines to the pump body 104 introduces the possibility that a bad connection may be made (i.e., an area in which a seal is formed may not be properly reestablished) or that, over time, the connections may fatigue and begin to leak.

Although they will be not described in great detail, other seals are also present in the prior art pump 100 which can also be present in the new pump 200. A front seal 170, 270 is disposed between the cover 112, 212 and the front face of the pump body 104, 204 to form a seal between the two items when the cover 112, 212 is attached to the pump body 104, 204. Additionally, there may be seals between the nut 160, 260 and rotor 114, 214 and the rotor 114, 214 and the shaft 108, 208 in order to prevent the ingress of fluids into the area of threading between the threaded portion 158, 258 of the shaft 108, 208 and the nut 160, 260.

Finally, before describing the revisions to the improved pump 200, it is worth noting that a "dead space" can develop between a radially outward facing surface 172 of the central portion 136 of the rotor 114 and the radially inward facing surface 128 of the hub 126. This "dead space" is identified in FIG. 3 using reference number 174 to denote a cross section of the annular volume. This space is referred to as a "dead space" because the fluid being pumped can collect in this annular volume 174 and become stagnant, as the wings 140 of the rotor 114 primarily transport or pump fluid on the outside of the hub 126.

The collection of fluid in this area often requires the disassembly of pump 100 to a point at which at least the rotors 114 are removed, because clean-in-place processes require adequate fluid flow through the areas to be cleaned. As these are "dead spaces" from a fluid transport perspective, clean-in-place solutions are not very effective at entering this annular volume 174.

Now with a general understanding of the prior art pump 100 structure and operation, modifications are described that can be made to the prior art pump 100 to result in the new pump 200. It will be appreciated that the new pump 200 could either be made by modifying an existing prior art pump such as pump 100 or could be manufactured as a brand new pump.

Perhaps the biggest difference between the two pumps 100 and 200 is that, in the new pump 200, a sliding seal subassembly 276 is inserted between the radially outward facing portion 272 of the central portion 236 of the rotor 214 and the radially inward facing surface 228 of the hub 226.

Among other things, the inclusion of this sliding seal subassembly 276 provides a sealing arrangement that is serviceable by removing the cover 212 attached to the pump body 204 and by removing a respective rotor 214 from its respective shaft. This means that each sliding seal subassembly 276 is front-loading in that each sliding seal subassembly 276 is removable from the pump body 204 without the removal of the pump body 204 from the gear case 202.

The inclusion of the sliding seal subassembly 276 in the space between the rotor 214 and the hub 226 also greatly reduces the volume of "dead space" as the sliding seal subassembly 276 occupies the annular volume 174 in the prior art pump 100. Because the sliding seal subassembly 276 can require more space than the annular volume 174 can provide, the radially inward facing surface 128 of the hub 126 may be removed in order to enlarge the axially-extending opening 132 of the hub 126 in the prior art pump 100 to the size of the axially-extending opening 232 in the hub 226 of the new pump 200.

In order to provide the enlarged opening from a pump body 104 from a prior art pump 100 (which may be, for example, a conventional Ampco Pumps® ZP2 Series positive displacement pump, a conventional Waukesha Cherry-Burnell® Universal II Series PD Pump, or a conventional Wright® TRA20 Series Pump), a volume of material is removed from each of the hubs 126 on the radially inward facing surfaces 128 of the axially-extending openings 132 of the hubs 126 to enlarge at least a portion of the axially-extending openings 132. In its simplest form, the step of removal can include boring a larger axially-extending opening into the original hub 126 (i.e., an opening of greater diameter). The step of removal may also include counter-boring a portion of the axially-extending opening 132 on the rear wall of the pump body 104 such that there is an even greater diameter counter bore on the rear wall.

Then, after removing a volume of the material in the old hubs 126 to form the new hubs 226, a sleeve 277 is inserted into each of the axially-extending openings 232 of the hubs 226 from a rear side of the pump body 204. The cross-sectional profile of this sleeve 277 can be seen best in FIGS. 4B and 4C. A radially outward facing surface of the sleeve 277 can be stepped so as to position the sleeve 277 in the counterbore of the axially-extending opening 232. Once positioned within the axially-extending opening 232, set screws (not shown) can be screwed into place to lock the sleeve 277 with respect to the pump body 204.

The sleeve 277 includes two forward and axially-facing surfaces 278 and 279 in the axially-extending opening of the hub 226. These forward and axially-facing surfaces 278 and 279 will be used in the positioning of the sliding seal subassembly 276 within the hub 226.

At this point, it is worth noting that the modification of the hub 126 of the pump body 104 described above is only one way of achieving an appropriately-sized opening to accommodate the sliding seal subassembly 276. In the particular prior art pump 100 illustrated, this described method is particularly workable because, even with the removal of a portion of the material from the hubs, the hubs are still structurally sound. It is contemplated that in other pump designs, material might be removed from the radially outward facing surface of the rotor as an alternative to or in addition to a removal of material from the inside of the hub. As still another alternative, the pump body might be newly formed with less material in the hub so as to accommodate the sliding seal subassembly 276 or might be formed in such a manner that the portion designated as the sleeve 277 is integrally formed with the pump body 204. However, such integration may inhibit future reconditioning of the pump.

Returning now to the illustrated modifications of the pump 100 to make the pump 200, once the hubs are modified, then the sliding seal subassemblies 276 can be assembled between the central portion 236 of the rotors 214 and the modified hubs 226 of the pump body 204. Although only a single sliding seal assembly 276 is illustrated in detail, it will be appreciated that both the top and bottom rotors 214 and hubs 226 can each receive a sliding seal assembly 276.

Conceptually, each sliding seal subassembly 276 can be broken down into two halves or portions: a stationary portion in the pump body 204 and a rotating portion in the rotor 214. Then when the rotor 214 is attached to the shaft 208, the two portions of the sliding seal subassembly 276 are brought together to establish a sliding interface between the two portions.

Looking first at the stationary portion, a biasing element in the form of a wave spring 280 is first inserted into the axially-extending opening 232 until the wave spring 280 is seated in the rearmost forward and axially-facing surface 278 of the sleeve 277. Although not illustrated, the wave spring 280 is positioned rearward of a pair of anti-rotation stationary drive pins (not shown) that are disposed between forward and axially-facing surfaces 278 and 279 of the sleeve 277.

Next, a stationary seal o-ring 281 is inserted into the axially-extending opening 232 of the hub 226 until it seats against the forwardmost forward and axially-facing surface 279 of the sleeve 277.

With both the wave spring 280 and the stationary seal o-ring 281 in place, a stationary seal member 282 is inserted into the axially-extending opening 232 until it seats against the wave spring 280. The stationary seal member 282 is generally annular and has, on a rearward axial face, a pair of slots 283 formed therein that align with the stationary drive pins in the sleeve 277 to rotationally fix or couple the stationary seal member 282 relative to the pump body 204. On a front axial face of the stationary seal member 282, there is a lapped surface that provides a stationary seal face 284 of the sliding interface.

It should be noted that, because the shaft 208 is already co-axially received in the hub 226 during assembly, the wave spring 280, the stationary seal o-ring 281 and the stationary seal member 282 are all also received over/around the shaft 208 although they do not substantially contact the shaft 208 when in place.

Turning now to the rotating portion of the sliding seal subassembly 276 and with additional reference to FIG. 8, the rotating portion of the sliding seal subassembly 276 includes a rotary seal member 285. As with the stationary seal member 282, the rotary seal member 285 is annular. A rotary seal o-ring 286 is stretched over the outer diameter of the rotary seal member 285 on a forward end thereof. With the rotary seal o-ring 286 attached, the rotary seal member 285 is telescopically slid over the central portion 136 of the rotor 214 such that the rotary o-ring 286 and a forward end of the rotary seal member 285 contact a rearward facing axial face 287 of the disc-shaped portion 242 of the rotor 214.

As with the stationary seal member 282, the rotary seal member 285 can have slots 289 formed therein that align with anti-rotation rotary seal pins 290 that are also received in the rearward facing axial face 287 of the rotor 214 to rotationally fix the rotary seal member 285 with respect to the rotor 214. When the rotary seal member 285 is fully received on the central portion 236 of the rotor 214 these rotary seal pins 290 cause the rotary seal member 285 to rotate with the rotor 217. Accordingly, these pins 290 couple the rotary seal member 285 to the rotor 214.

On the rearward axially facing surface of the rotary seal member 285, there is a lapped surface that provides a rotary seal face 291 that forms the other half of the sliding interface.

At this point, the rotor 214 (with the rotary seal member 285 coupled thereto) can be placed onto the shaft 208 to bring the two portions of the sliding seal subassembly 276 together. With the rotor 214 received on the shaft 208, a Bellville washer 292 is inserted on the nut 260 and a retaining o-ring 293 is attached to the nut 260 so as to retain the Bellville washer 292 on the nut 260. Additionally, the rotor nut o-ring 262 is attached to an outer periphery of the nut 260. With these items attached to the nut 260, the nut 260 is fastened onto the threaded portion 258 of the shaft 208 so as to couple the rotor 214 onto the shaft 208 and to compress the portions of the sliding seal subassembly 276 together.

As a result of the attachment of the rotors 214 to the shafts 208, the sliding seal subassembly 276 is formed which includes a number of seals.

Two seals of the sliding seal subassembly 276 are formed by the compression of o-rings. The stationary seal o-ring 281 is disposed between and contacts the stationary seal member 282, a surface of the axially-extending opening 232 of the hub 226, and the axially-facing surface 279 of the sleeve 277 to form a seal there between. The rotary seal o-ring 286 is disposed between and contacts the rotary seal member 285 and the respective rotor 214 to form a seal there between.

Perhaps most notably, in order to accommodate rotation of the rotor 214 relative to the pump body 204, the rotary seal face 291 of the rotary seal member 285 and the stationary seal face 284 of the stationary seal member 282 contact one another to establish a sliding interface there between when the respective rotor 214 rotates relative to the pump body 204. In order to provide a good seal and wear properties, the stationary seal member 282 and the rotary seal member 285 can have tungsten carbide seal faces or be composed of other wear-resistant materials or coatings.

Accordingly, in combination with the two o-ring seals described two paragraphs previous, this sliding interface forms a sealing arrangement between the rotor 214 and the pump body 204 that is completely front-loading and obviates the need for the sealing arrangement 164 between the pump body 104 and the gear case 102 found in conventional pumps. Among other things, the sliding interface between the rotary seal face 291 and the stationary seal face 284 is closer to the areas of turbulent flow in the internal cavity 216 than the previous sealing arrangement 164 at the base of the shaft 108 in pump 100. This eliminates the vast majority of the area of the dead zone as the seal has been moved forward in the pump 200 as well as the rearwardmost o-ring arrangement of the stationary seal components.

Additionally, the attachment of the rotor 214 to the shaft 208 establishes a few other seals to protect the area of attachment between the rotor 214 and the shaft 208. The rotor nut o-ring 262 forms a seal between the nut 260 and the rotor 214.

At this point with the rotors 214 attached to the shafts 208 and the sliding seal subassemblies 276 constructed, the cover 212 can be attached to the front side of the pump body 204 in order to complete and seal the internal cavity 216. As mentioned above, a compressible seal 270 can be sandwiched between these components so that only the inlet 218 and the outlet 220 provide access to the internal cavity 216 of the pump 200.

Accordingly, the new sliding seal subassembly 276 eliminates the need for removal of the pump body 204 from the gear case 202 in order to service or clean the pump 200. However, the pump 200 also includes a number of additional features that improve the ability of the new pump 200 to be cleaned in place.

According to one modification, in each rotor 214 there can be a clean-in-place opening 295 that extends through the disc-shaped portion 242 of the rotor 214. As illustrated, this clean-in-place opening 295 extends from a front axial face 296 of the disc-shaped portion 242 to an area on the opposing rearward axially facing surface 287 of the disc-shaped portion 242 that is annularly bounded by the wings 240 of the rotor 214 and the radially outward facing surface 272 of the central portion 236 of the rotor 214. These clean-in-place openings 295 in the rotors 214 permit the rotors 214 to be self-draining and encourages turbulent flow in the area between the rotor 214 and the cover 212 and in the area of the sliding seal subassembly 276 because of the position of the clean-in-place opening 295.

According to another modification, pump body 204 can be altered to provide a free drain arrangement. As best illustrated in FIG. 7, the lateral sidewalls 222 and 224 of the pump body 204 include an arcuate section 297 near the inlet 218 and outlet 220 matching a path of the wings 240 of the rotor 214. By removing a portion of material of the arcuate section 297 closest to a front face of the lateral sidewalls 222 and 224, a free drain 298 is provided by an absence of material between the arcuate section 297 and a front face of the lateral sidewalls 222 and 224. This accommodates for fluid drainage between the area of the cover 212 and the rotors 214 into the regions near the inlet 218 and outlet 220. Although this free drain 298 permits drainage of this area, it surprisingly does not sacrifice the pumping performance of the pump 200.

According to the modifications described above, an improved pump is provided that has a front loading seal and an improved ability to be cleaned in place. These improvements can be implemented by modifying or reconditioning existing positive rotary positive displacement pumps. Moreover, the modifications permit a large number of the components (e.g., gear case, cover, and so forth) to be interchangeably used in either the old or the modified pump.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A rotary positive displacement pump for pumping a fluid, the rotary positive displacement pump comprising:

a gear case supporting a pair of shafts;

a pump body supported by the gear case, the pump body having a cover attached there to so as to define a cavity between the pump body and the cover in which the cavity has an inlet and an outlet, the pump body having a pair of hubs that extend into the cavity in which each of the pair of hubs has an axially-extending opening through each one of which a corresponding one of the pair of shafts from the gear case is received wherein each of the pair of hubs is generally cylindrically tubular having a radially inward facing surface defining the axially-extending opening and further having a radially outward facing surface defining a portion of the cavity;

a pair of rotors each having a central portion received on a corresponding one of the pair of shafts inside the axially-extending opening of a corresponding one of the hubs, each rotor having wings attached to the central portion of the rotor in which the wings of the rotor are disposed radially outward of the radially outward facing surface of the hub when the central portion of the rotor is attached to the shaft, the pair of rotors on the respective pair of shafts being rotatable in opposite directions to pump a fluid through the pump body from the inlet through the cavity to the outlet; and a sliding seal subassembly disposed in a volume between a radially outward facing surface of the central portion of each of the rotors and the radially inward facing surface of their corresponding hub in the pump body.

2. The rotary positive displacement pump of claim 1 wherein each sliding seal subassembly is serviceable by removing the cover attached to the pump body and by removing the respective rotor from its respective shaft, thereby making each sliding seal subassembly front-loading in that each sliding seal subassembly is removable from the pump body without the removal of the pump body from the gear case.

3. The rotary positive displacement pump of claim 1 wherein the pair of hubs protrude from a rear wall of the pump body in which the rear wall of the pump body is also supported by the gear case.

4. The rotary positive displacement pump of claim 1 wherein each sliding seal subassembly comprises:

a rotary seal member having a rotary seal face, the rotary seal member coupled to the respective rotor; and a stationary seal member having a stationary seal face, the stationary seal member coupled to the pump body;

wherein the rotary seal face and the stationary seal face contact one another to establish a sliding interface there between when the respective rotor rotates.

5. The rotary positive displacement pump of claim 4 wherein the rotary seal face and the stationary seal face are lapped surfaces and are disposed on axial faces of the rotary seal member and the stationary seal member.

6. The rotary positive displacement pump of claim 4 wherein each sliding seal subassembly further comprises:

a stationary seal o-ring disposed between the stationary seal member and a surface of the axially-extending opening of the hub to form a seal there between; and a rotary seal o-ring disposed between the rotary seal member and the respective rotor to form a seal there between.

7. The rotary positive displacement pump of claim 6 wherein each sliding seal subassembly further comprises at least one biasing element that axially biases the stationary seal member and the rotary seal member toward one another.

8. The rotary positive displacement pump of claim 7 wherein the at least one biasing element is a wave spring disposed between the stationary seal member and a sleeve disposed in the axially-extending opening of the hub and wherein the stationary seal o-ring further contacts the sleeve to form a seal there between.

9. The rotary positive displacement pump of claim 6 wherein each sliding seal subassembly further comprises at least one spring that axially biases the stationary seal member and the rotary seal member toward one another.

10. The rotary positive displacement pump of claim 4 wherein the rotary seal member is rotationally fixed relative to the respective rotor and the stationary seal member is rotationally fixed relative to the pump body.

11. The rotary positive displacement pump of claim 4 wherein the rotary seal member is rotationally fixed relative to the respective rotor by anti-rotation pins that engage both the rotary seal member and the respective rotor.

12. The rotary positive displacement pump of claim 1 wherein the inlet and the outlet of the cavity are disposed on opposite lateral sides of the pump body.

13. The rotary positive displacement pump of claim 1 wherein, in each rotor, the wings and the central portion are each attached to a disc-shaped portion.

14. The rotary positive displacement pump of claim 13 wherein, in each rotor, there is a clean-in-place opening that extends through the disc-shaped portion.

15. The rotary positive displacement pump of claim 14, wherein the clean-in-place opening extends from a front axial face of the disc-shaped portion to an opposing axially facing annular surface of the disc-shaped portion that is bounded by the wings of the rotor and a radially outward facing surface of the central portion of the rotor.

16. The rotary positive displacement pump of claim 1, wherein a lateral wall of the pump body includes an arcuate section matching a path of the wings of the rotor and wherein a free drain is provided by an absence of material between the arcuate section between a front face of the lateral wall.

17. The rotary positive displacement pump of claim 1 wherein each sliding seal subassembly forms a seal between the respective rotor and the corresponding hub in which the seal extends around an entire circumferential distance in the volume between the respective rotor and the corresponding hub.

18. A method of modifying a rotary positive displacement pump for pumping a fluid, the rotary positive displacement pump comprising a gear case supporting a pump body having a cover attachable there to so as to define a cavity between the pump body and the cover in which the cavity has an inlet and an outlet, the pump body having a pair of hubs that extend into the cavity in which each of the pair of hubs has an axially-extending opening through each one of which a corresponding one of a pair of shafts from the gear case is receivable wherein each of the pair of hubs is generally cylindrically tubular having a radially inward facing surface defining the axially-extending opening and further having a radially outward facing surface defining a portion of the cavity, each of the pair of shafts having a central portion of a rotor receivable there on inside the axially-extending opening of the hub, each rotor having wings attached to the central portion of the rotor in which the wings are disposed radially outward of the radially outward facing surface of the hub when the central portion of the rotor is attached to the shaft, the rotors on the pair of shafts being rotatable in opposite directions to pump a fluid through the pump body from the inlet through the cavity to the outlet, the method comprising:

removing a volume of material from each of the hubs on a radially inward facing surface of the axially-extending openings of the hubs to enlarge at least a portion of the axially-extending openings; and thereafter assembling sliding seal subassemblies between a radially outward facing surface of the central portion of the rotors and the radially inward facing surface of the hubs of the pump body.

19. The method of claim 18 further comprising the step of inserting a sleeve in the axially-extending opening of the hub after removing a respective volume of each of the hubs, but prior to assembling the sliding seal subassemblies, so as to provide at least one axially facing surface in the axially-extending opening of the hub.

20. The method of claim 18 wherein the step of assembling sliding seal subassemblies between the central portion of the rotors and the hubs of the pump body includes:

inserting a rotary seal member over the central portion of the rotor, the rotary seal member having a rotary seal face;

inserting a stationary seal member into the axially-extending opening of the hub, the stationary seal member having a stationary seal face; and attaching the rotor to the shaft such that the rotary seal face and the stationary seal face contact one another to establish a sliding interface there between when the rotor rotates relative to the pump body.

21. The method of claim 20 wherein the step of assembling sliding seal subassemblies between the central portion of the rotors and the hubs of the pump body further includes:

placing a stationary seal o-ring between the stationary seal member and a surface on the axially-extending opening of the hub to form a seal there between; and placing a rotary seal o-ring between the rotary seal member and the respective rotor to form a seal there between.

22. The method of claim 18 wherein the step of assembling the sliding seal subassembly includes, at least in part, the attachment of the rotors to the shafts to bring a pair of portions of the sliding seal subassembly into contact with one another so as to establish a sliding interface between the pair of portions of the sliding seal subassembly.

23. The method of claim 18 wherein each sliding seal subassembly forms a seal between the respective rotor and the corresponding hub in which the seal extends around an entire circumferential distance in a volume between the respective rotor and the corresponding hub.

* * * * *